US010619446B2

(12) United States Patent
Webster

(10) Patent No.: US 10,619,446 B2
(45) Date of Patent: Apr. 14, 2020

(54) ANGLED EXTRUSION LIMITER

(71) Applicant: General Plastics & Composites, L.P., Houston, TX (US)

(72) Inventor: Nicholas Jeffery Webster, Houston, TX (US)

(73) Assignee: GENERAL PLASTICS & COMPOSITES, L.P., Houston, TX (US)

( * ) Notice: Subject to any disclaimer, the term of this patent is extended or adjusted under 35 U.S.C. 154(b) by 138 days.

(21) Appl. No.: 15/645,204

(22) Filed: Jul. 10, 2017

(65) Prior Publication Data

US 2018/0016863 A1 Jan. 18, 2018

Related U.S. Application Data

(60) Provisional application No. 62/361,222, filed on Jul. 12, 2016.

(51) Int. Cl.

| | |
|---|---|
| ***E21B 33/128*** | (2006.01) |
| ***E21B 33/12*** | (2006.01) |
| ***E21B 33/129*** | (2006.01) |

(52) U.S. Cl.

CPC ..... *E21B 33/128* (2013.01); *E21B 33/1216* (2013.01); *E21B 33/1293* (2013.01)

(58) Field of Classification Search

CPC ..... E21B 33/1216; E21B 33/128

See application file for complete search history.

(56) References Cited

U.S. PATENT DOCUMENTS

| | | | | |
|---|---|---|---|---|
| 3,061,012 | A * | 10/1962 | Moosman | E21B 33/12 277/337 |
| 3,306,362 | A * | 2/1967 | Urbanosky | E21B 33/1204 166/123 |
| 5,678,635 | A | 10/1997 | Dunlap et al. | |
| 5,879,010 | A * | 3/1999 | Nilkanth | E21B 33/1216 277/545 |
| 6,598,672 | B2 * | 7/2003 | Bell | E21B 33/1216 166/118 |
| 6,793,022 | B2 * | 9/2004 | Vick | E21B 33/1208 166/118 |
| 7,373,973 | B2 | 5/2008 | Smith et al. | |
| 7,735,549 | B1 * | 6/2010 | Nish | E21B 33/134 166/134 |

(Continued)

FOREIGN PATENT DOCUMENTS

WO 2017177227 10/2017

*Primary Examiner* — Shane Bomar

(74) *Attorney, Agent, or Firm* — Jonathan Pierce; Pierre Campanac; Porter Hedges LLP

(57) ABSTRACT

A downhole tool includes a mandrel and a deformable seal positioned around the mandrel to hold overpressure. An extrusion limiter is positioned around the mandrel, and adjacent to the deformable seal. The extrusion limiter includes a body, and grooves formed into the body that separate fins. The grooves have at least one portion formed at an acute angle relative to a circumferential line centered on the central axis of the extrusion limiter body. After the bending of the fins that occurs in use of the extrusion limiter, the gaps left by the grooves between the fins may be smaller than gaps left by straight grooves that are perpendicular to circumferential lines centered on the central axis of the body. The smaller gaps reduce extrusion of the deformable seal.

6 Claims, 3 Drawing Sheets

(56) References Cited

U.S. PATENT DOCUMENTS

| | | | | |
|---|---|---|---|---|
| 7,779,928 | B2 * | 8/2010 | Turley | E21B 33/1208 166/118 |
| 8,479,809 | B2 | 7/2013 | Farquhar | |
| 2003/0226659 | A1 * | 12/2003 | Smith | E21B 33/1204 166/118 |
| 2009/0255690 | A1 | 10/2009 | Conner et al. | |
| 2012/0217025 | A1 * | 8/2012 | Shkurti | E21B 33/1216 166/387 |

* cited by examiner

ANGLED EXTRUSION LIMITER

CROSS-REFERENCE TO RELATED APPLICATIONS

This application claims priority to U.S. Provisional Application Ser. No. 62/361,222 filed on Jul. 12, 2016, which is incorporated herein by reference.

BACKGROUND

This disclosure relates to extrusion limiters for downhole oilfield tools. The extrusion limiters may typically be used in a fracturing plug, bridge plug, or packer, but may also be used in similar products that require contact or interaction with a cylindrical wall such as of well casing, pipe, etc. . . . .

Extrusion limiters typically include fins that are provided on a fracturing plug wedge or cone. The fins are delimited by straight, radial cuts. The number of fins created by these cuts can vary from two to as many as are necessary. A typical number of fins would be six to eight. During the setting of the fracturing plug, the fins break or bend outward and bridge the annulus between the mandrel of the fracturing plug and well casing or pipe. The fins help mitigate extrusion of an element made of rubber or equivalent material which is typically used for sealing against well casing.

A problem with extrusion limiters having fins delimited by straight cuts is that when the fins bend outward, the cuts may leave large gaps between the fins, and the gaps may allow some extrusion of the rubber. Although useful for most applications, extrusion limiters made with straight cuts may fail to provide adequate support to the rubber for limiting extrusion, especially when temperatures and/or pressures are high and rubber flows more easily through the gaps left between the fins. A common solution for improving support to the rubber is to include two sets of extrusion limiters with cuts that do not overlap each other. However, this solution requires additional components and leads to additional cost.

Thus, there is a continuing need in the art for extrusion limiters.

BRIEF SUMMARY OF THE DISCLOSURE

An extrusion limiter comprises a body having an axis, and a groove formed into the body. The groove comprises at least one groove portion formed at an acute angle relative to a circumferential line centered on the axis. The body may be made of a drillable material. The body may be unitary. The body may include a first portion having a cylindrical inner surface and a second portion having a conical inner surface; the first portion may be adjacent the second portion. The groove may be formed in the second portion of the body. The at least one groove portion may further be formed at an acute angle relative to a radial line originating from the axis. The at least one groove portion may further be formed at an acute angle relative to a longitudinal line parallel to the axis. The groove may further comprise at least another groove portion formed into the body. The at least one groove portion may be formed into the body at a first angle relative to a first circumferential line centered on the axis and the at least another groove portion may be formed at a second angle relative to a second circumferential line centered on the axis; the second angle may be different from the first angle. The first angle is an acute angle relative to the first circumferential line. The second angle may be an acute angle relative to the second circumferential line, or may be perpendicular to the second circumferential line. The groove may be curved. The groove may be shaped as a spiral. The extrusion limiter may further comprise a circumferential notch formed into the body. The circumferential notch may intersect the groove. When the body includes a first portion having a cylindrical inner surface and a second portion having a conical inner surface; the circumferential notch may be formed between the first and second portions.

A downhole tool comprises a mandrel, a deformable seal positioned around the mandrel, and an extrusion limiter positioned adjacent to the deformable seal. The extrusion limiter includes a body having an axis, and a groove formed into the body. The groove comprises at least one groove portion formed at an acute angle relative to a circumferential line centered on the axis. The downhole tool may further comprise expandable slips and a wedge that is configured to expand the expandable slips, and the extrusion limiter may be made integral to the wedge.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
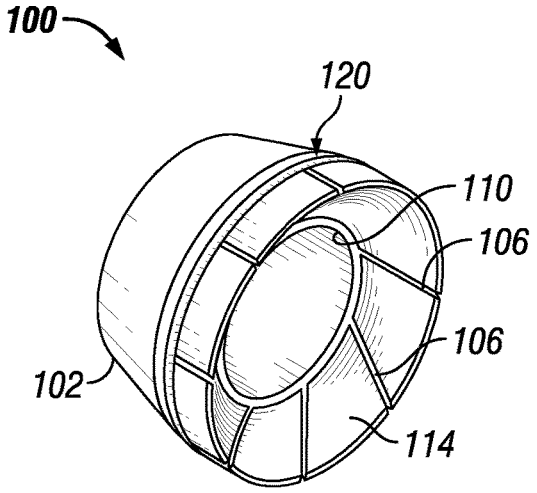
FIG. 1 is a perspective view of an extrusion limiter according to one example embodiment of this disclosure.
Figure 2:
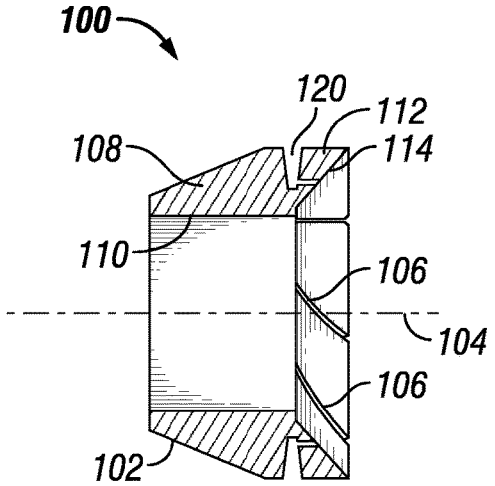
FIG. 2 is a longitudinal sectional view of the extrusion limiter shown in FIG. 1.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 3:
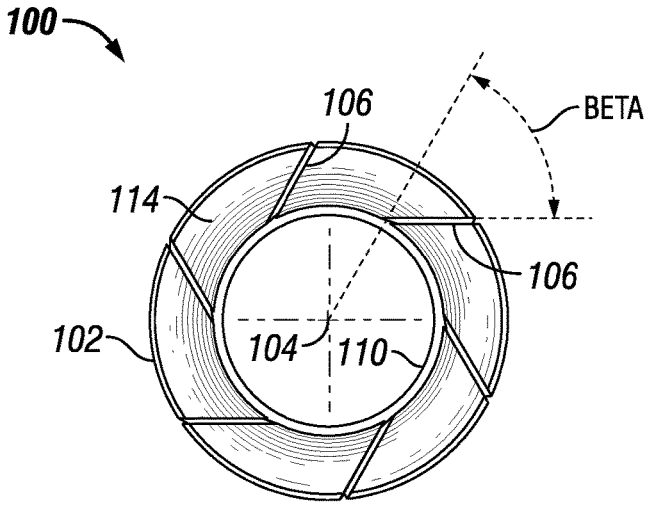
FIG. 3 is a cross-longitudinal view of the extrusion limiter shown in FIG. 1.
Figure 4:
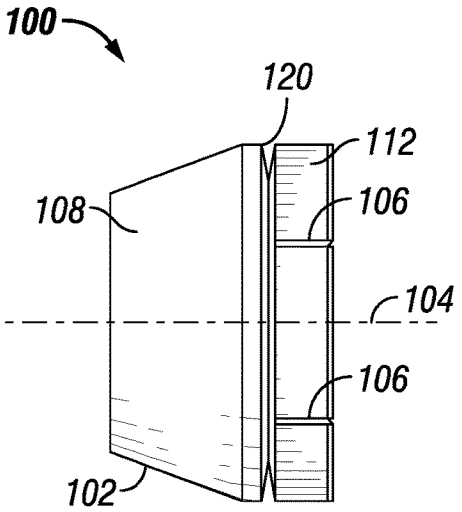
FIG. 4 is a longitudinal view of the extrusion limiter shown in FIG. 1.
Figure 9:
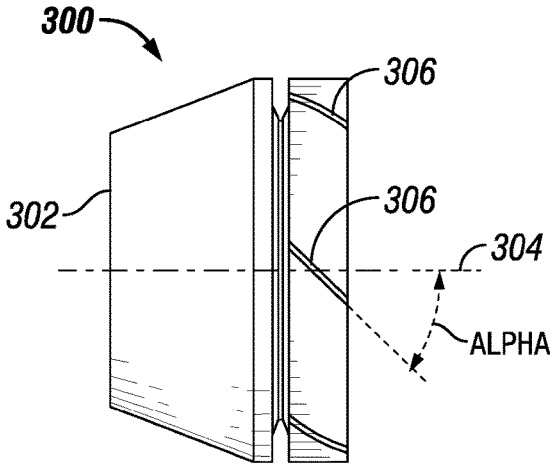
FIG. 9 is a longitudinal view of the extrusion limiter shown in FIG. 8.

A problem exhibited by extrusion limiters made with straight cuts may be that when the fins bend outward, the cuts may leave large gaps between the fins, and the gaps may allow some extrusion of the rubber. This problem may be addressed by delimiting the fins with one or more angled or curved grooves. The grooves may be cut, machined, molded, or otherwise formed at an acute angle (i.e. not a perpendicular angle) relative to any direction such as to obtain the desired effect of reducing the size of the gap left between two fins after the fins bend outward. One example may be to add an angle 'Beta' to the radial direction to determine the direction of the grooves, which is shown in FIG. 3. Another example may be to add an angle 'Alpha' to the longitudinal direction to determine the direction of the grooves, which is shown in FIG. 9. Any combination of angles (Beta', 'Alpha') can be added to the radial direction and the longitudinal direction to determine the groove direction. As such, the grooves are formed at an acute angle relative to circumferential lines, that is, the grooves are not perpendicular to the circumferential lines. Additionally, the grooves may optionally be curved, or may consist of any non-planar groove. For example, a groove may be formed by combinations of curved and/or planar portions. In particular, a groove may include a combination of two planar portions at different angles, or a combination of a curved portion and a planar portion. Some of the planar portions may remain straight and perpendicular to circumferential lines. In some cases, a few grooves may remain straight and perpendicular to circumferential lines, for examples when these grooves are short.

An extrusion limiter having at least some angled and/or curved grooves can be made integral to other components a downhole oilfield tool, such as a slip expansion cone or wedge, so as to reduce the amount of components of the downhole oilfield tool. The extrusion limiter may be unitary, that is, made of a single piece consisting of one material. Preferably, the material may be drillable or millable using a bit such as used for oil and gas exploration or production. For example, the material may consist of a soft metal such as aluminum, or a composite having a reinforced polymer matrix.

Referring initially to FIGS. 1-4, an extrusion limiter 100 comprises a body 102 having a central axis 104. The body 102 may be made of a drillable material. The body 102 may be unitary. The body 102 may include a first portion 108 having a cylindrical inner surface 110 and a second portion 112 having a conical inner surface 114. The first portion 108 may be adjacent the second portion 112.

The body includes one or more grooves 106 formed into the body 102 at an acute angle relative to a circumferential line centered on the central axis 104. In other words, the grooves 106 are not perpendicular to the circumferential lines centered on the central axis 104. The acute angle between the grooves 106 and the circumferential lines may be determined, for example, by adding an angle 'Beta' to the radial direction (see FIG. 3). The angle 'Beta' may be approximately 45 degrees, and more generally, may be comprised between 20 and 80 degrees, for example. As such, the grooves 106 may further be formed at an acute angle relative to radial lines originating from the central axis 104. In the example shown, the grooves 106 are formed in the second portion 112 of the body 102. Also, all the grooves 106 are shown formed at the same acute angle relative to any circumferential line centered on the central axis 104. In other examples however, different grooves may be formed at different angles relative to circumferential lines centered on the central axis 104, and a few of the grooves, especially if sufficiently short, may remain perpendicular to the circumferential lines centered on the central axis 104. The grooves 106 may be formed into the body 102 by machining, cutting, molding, or other forming processes.

The extrusion limiter may further comprise a circumferential notch 120 formed into the body 102. The circumferential notch 120 may intersect the grooves 106. The circumferential notch 120 may be formed between the first and second portions 108 and 112, respectively.

Figure 5:
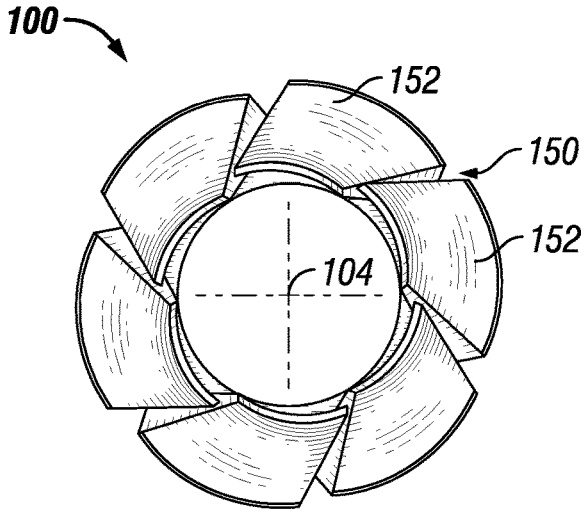
FIG. 5 is a cross-longitudinal view of the extrusion limiter shown in FIG. 1 illustrating the gaps between the fins after bending the fins that occurs in use of the extrusion limiter.
Figure 6:
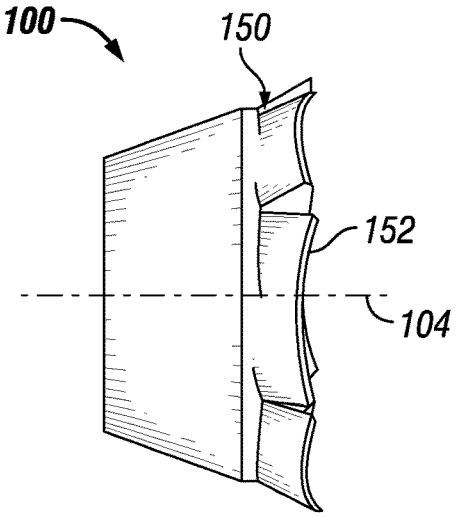
FIG. 6 is a longitudinal view of the extrusion limiter shown in FIG. 1 illustrating the gaps between the fins after bending the fins that occurs in use of the extrusion limiter.

Referring now to FIGS. 5 and 6, gaps 150 between the fins are illustrated after the bending of the fins that occurs in use of the extrusion limiter 100. The gaps 150 left by the grooves 106 may be smaller than gaps (not shown) left by straight grooves that are perpendicular to circumferential lines centered on the central axis 104. Smaller gaps help to mitigate extrusion of a rubber element pressed against surface 152 of the extrusion limiter 100 and allow the rubber element to seal even at high temperatures and/or pressures. The shape of the gaps 150 may also better prevent extrusion of the rubber element than the gaps (not shown) left by straight grooves that are perpendicular to circumferential lines centered on the central axis 104.

Figure 7A:
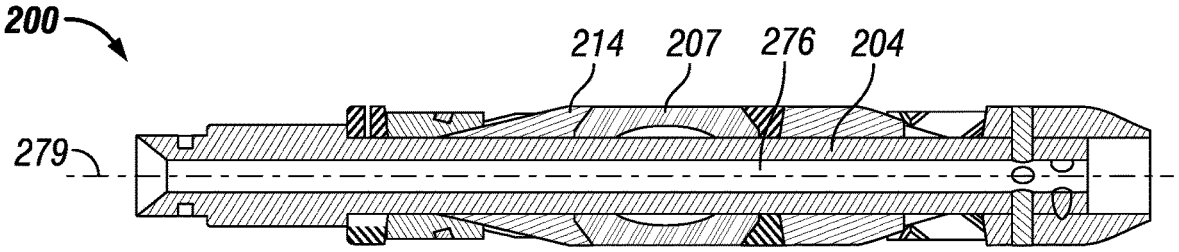
FIG. 7A is a sectional schematic of a downhole tool including an extrusion limiter according to one example embodiment of this disclosure.

Referring now to FIG. 7A, a downhole tool 200 comprises a mandrel 204, a deformable seal 207 positioned around the mandrel 204, and an extrusion limiter 214 positioned adjacent to the deformable seal 207. The deformable seal 207 may include a rubber element or other functionally equivalent element. The extrusion limiter 214 includes a body having a central axis 279, and a groove formed into the body at an acute angle relative to a circumferential line centered on the central axis 279, for example as described herein in FIGS. 1-4. The extrusion limiter 214 can be made integral to other components of a downhole oilfield tool. In the example shown, the extrusion limiter 214 is provided on a cone or wedge that is configured to expand slips.

In use, the extrusion limiter 214 slides on the mandrel 204. The deformable seal 207 expands radially against a wall of a well casing or pipe (not shown) and seals the annulus between the mandrel and the well casing or pipe. The deformable seal 207 may hold overpressure that may be applied on the right of FIG. 7. Extrusion of the deformable seal 207 past the extrusion limiter 214 may be reduced by bending fins of the extrusion limiter 214 to adequately support the deformable seal 207.

Figure 7B:
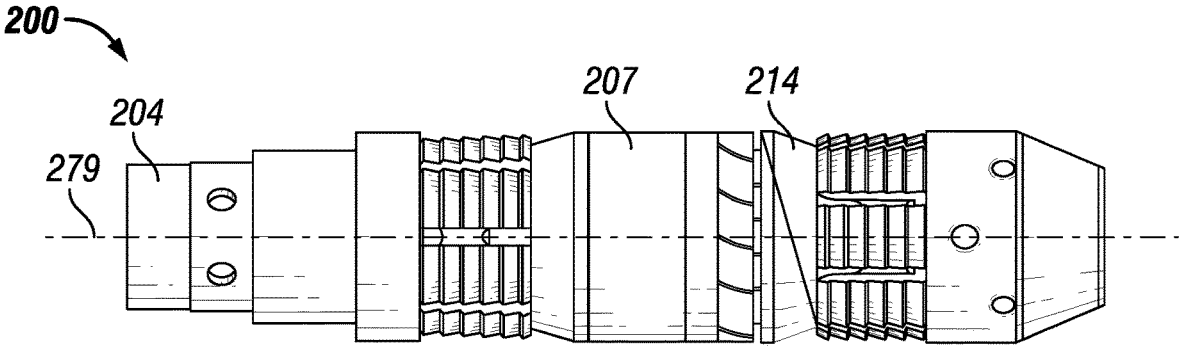
FIG. 7B is a schematic of another downhole tool including an extrusion limiter according to an example embodiment of this disclosure.

Referring now to FIG. 7B, a downhole tool 200, which is similar to the downhole tool shown in FIG. 7A, comprises an extrusion limiter 214. Compared to the downhole tool shown in FIG. 7A, the extrusion limiter 214 is located on the other side of the deformable seal 207. The deformable seal 207 may hold overpressure that may be applied to the left of FIG. 7B. The extrusion limiter 214 may also reduce extrusion of the deformable seal 207 toward the right of FIG. 7B.

Figure 8:
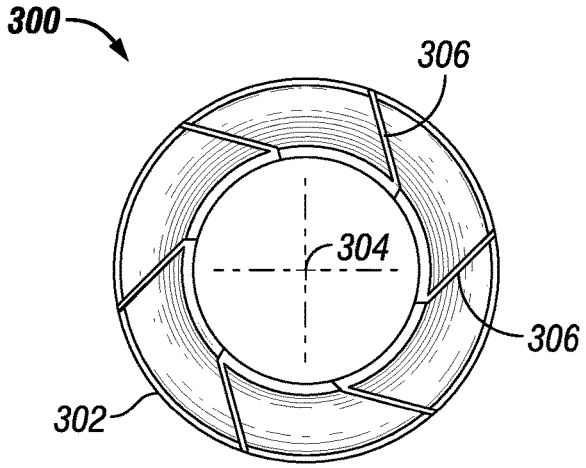
FIG. 8 is a cross-longitudinal view of according to one example embodiment of this disclosure.

Referring now to FIGS. 8 and 9, an extrusion limiter 300 comprises a body 302 having a central axis 304. The body includes one or more grooves 306 formed into the body 302 at an acute angle relative to a circumferential line centered on the central axis 304. In the example shown, the acute angle between the grooves 306 and the circumferential lines is determined by adding an angle 'Alpha' to the longitudinal direction. The angle 'Alpha' may be approximately 45 degrees, and more generally, may be comprised between 30 and 60 degrees, for example. As such, the grooves 306 may further be formed at an acute angle relative to longitudinal lines parallel to the central axis 304.

Figure 10:
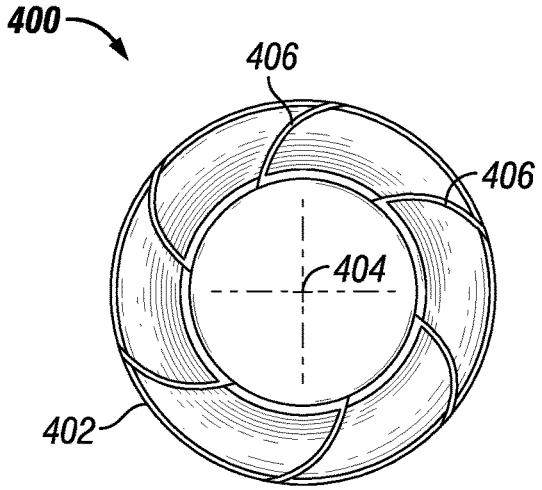
FIG. 10 is a cross-longitudinal view of according to one example embodiment of this disclosure.
Figure 11:
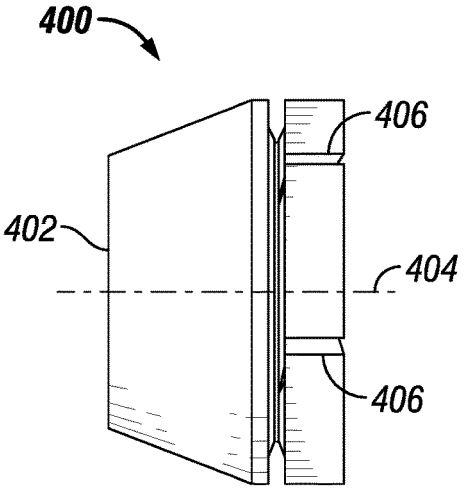
FIG. 11 is a longitudinal view of the extrusion limiter shown in FIG. 10.

Referring now to FIGS. 10 and 11, an extrusion limiter 400 comprises a body 402 having a central axis 404. The body includes one or more grooves 406 formed into the body 402 at an acute angle relative to a circumferential line centered on the central axis 404. In the example shown, the grooves 406 are curved and may be shaped as spirals. As such, the angle of portions of the grooves 406 close to the central axis 404, relative to a circumferential line, is almost perpendicular; and the portions of the grooves 406 far from the central axis 404 are almost aligned with a circumferential line. Thus, the grooves 406 may be formed into the body 402 at a first acute angle relative to a first circumferential line centered on the central axis 404 and at a second acute angle relative to a second circumferential line centered on the central axis 404; the second acute angle may be different from the first acute angle.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. An extrusion limiter, comprising:

a body having a central axis, a peripheral surface, and an inner surface contiguous to the peripheral surface;

a groove, wherein the groove has a first elongated aperture in the peripheral surface of the body and a second elongated aperture in the inner surface of the body;

a pair of fins, wherein the pair of fins are adjacent and separated by the groove;

wherein the groove forms a gap between a first surface of one of the pair of fins and a second surface of the other of the pair of fins, the first surface facing the second surface, wherein the first surface is contiguous to the first elongated aperture and the second elongated aperture, wherein the second surface is contiguous to the first elongated aperture and the second elongated aperture;

wherein first surface is formed at an acute angle between twenty and eighty degrees relative to a radial line originating from the central axis.

2. An extrusion limiter, comprising:

a body having a central axis, a peripheral surface, and an inner surface contiguous to the peripheral surface;

a groove, wherein the groove has a first elongated aperture in the peripheral surface of the body and a second elongated aperture in the inner surface of the body, a pair of fins, wherein the pair of fins are adjacent and separated by the groove;

wherein the groove forms a gap between a first surface of one of the pair of fins and a second surface of the other of the pair of fins, the first surface facing the second surface, wherein the first surface is contiguous to the first elongated aperture and the second elongated aperture, wherein the second surface is contiguous to the first elongated aperture and the second elongated aperture;

wherein the first surface is formed at an acute angle between thirty and sixty degrees relative to a longitudinal line parallel to the central axis.

3. An extrusion limiter, comprising:

a body having a central axis; and a groove formed into the body, wherein the groove comprises at least one groove portion formed into the body at a first angle relative to a first circumferential line centered on the axis, wherein the groove further comprises at least another groove portion formed into the body at a second angle relative to a second circumferential line centered on the axis; and wherein the second angle is acute relative to the second circumferential line, and the second angle is different from the first angle.

4. The extrusion limiter of claim 3, wherein the groove is curved.

5. The extrusion limiter of claim 4, wherein the groove is shaped as a spiral.

6. An apparatus for use in a downhole tool including expandable slips and a deformable seal, the apparatus comprising:

a wedge, wherein the wedge is configured to expand the expandable slips;

an extrusion limiter, wherein the extrusion limiter is made integral to the wedge, wherein the extrusion limiter has a central axis, the extrusion limiter including a plurality of fins that are disposed circumferentially around the central axis and delimited by grooves;

wherein at least one of the grooves extends along a plane located in a middle of a gap between two successive fins of the plurality of fins, the plane not containing the central axis, whereby extrusion of the deformable seal past the extrusion limiter is reduced.

* * * * *